US006403898B2

(12) United States Patent
Janniere et al.

(10) Patent No.: US 6,403,898 B2
(45) Date of Patent: Jun. 11, 2002

(54) MULTIPLE SWITCH ASSEMBLY

(75) Inventors: Alain Janniere, Paris (FR); Alfred Heeb, Glienicke (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/870,211

(22) Filed: May 28, 2001

(30) Foreign Application Priority Data

Jun. 2, 2000 (DE) ..... 100 27 446

(51) Int. Cl.[7] ..... H01H 25/04
(52) U.S. Cl. ..... 200/6 A
(58) Field of Search ..... 200/4, 6 R, 6 A, 200/17 R, 18, 332, 335

(56) References Cited

U.S. PATENT DOCUMENTS

| | | | | |
|---|---|---|---|---|
| 3,400,232 A | * | 9/1968 | Mathey | 200/18 |
| 3,731,013 A | * | 5/1973 | Nightengale | 200/4 |
| 4,408,103 A | * | 10/1983 | Smith, III | 200/6 A |
| 4,486,629 A | * | 12/1984 | Sledesky | 200/6 A |
| 4,492,830 A | * | 1/1985 | Kim | 200/6 A |
| 4,614,847 A | * | 9/1986 | Sasao | 200/6 A |
| 5,621,196 A | * | 4/1997 | Nishijima et al. | 200/6 A |
| 6,084,189 A | * | 7/2000 | Menche et al. | 200/315 |

FOREIGN PATENT DOCUMENTS

| | | | |
|---|---|---|---|
| DE | 38 34 390 C1 | 10/1988 | H01H/25/06 |
| DE | 44 09 460 C1 | 3/1994 | H02B/1/048 |
| DE | 196 37 533 A1 | 9/1996 | G05G/9/02 |
| WO | WO91/15864 | 4/1990 | H01H/25/04 |

* cited by examiner

*Primary Examiner*—Michael Friedhofer
(74) *Attorney, Agent, or Firm*—Roger C. Turner

(57) ABSTRACT

An electrical switch assembly includes a lever (18) lying on a vertical axis (102) and pivotable about horizontal axes (NS and EW). The lever has arms (20) extending in perpendicular horizontal directions, the arms serving to close corresponding switches (100) when the lever is pivoted to depress a corresponding one of the arms. Each arm carries a cam follower (25) that is biased against a cam surface (44) and each cam follower can largely vertically slide or roll along a cam surface. A convex cam surface region (134) results in a sudden decrease in resistance to lever pivoting as the arm closes a switch, to provide tactile feedback similar to that of a snap dome. The lever has a spherical bearing (19) that is trapped between a spherical surface (27) on the housing base (12) and a spherical surface (26) on a housing cover (13), with the arms extending through gap areas. The housing has a square cavity shape and the arms extend toward the corners.

6 Claims, 4 Drawing Sheets

MULTIPLE SWITCH ASSEMBLY

CROSS-REFERENCE TO RELATED APPLICATION

Applicant claims priority from German patent application 100 27 446.3 filed Jun. 2, 2000.

BACKGROUND OF THE INVENTION

A quadrant switch includes a single lever that can be pivoted in a plurality of directions to operate a selected one of several switches. One example is a quadrant switch used in motor vehicles to shift the position of a rear view mirror or seat. Operation of each of the plurality of switches by manipulation of a single lever, avoids the need for a person to move the person's hand between different switches. Our earlier U.S. Pat. No. 6,198,054 shows an example of a multiple switch.

It is often desirable to provide tactile feedback to a person operating the switch handle, to indicate when a switch had been activated (closed or opened). In some switches, this is accomplished by the use of a snap dome that suddenly snaps down when depressed beyond a certain point, to generate a "click" that can be felt. One disadvantage of snap domes is that it can be difficult to closely control the force required for snapping them, especially when a low force is required.

SUMMARY OF THE INVENTION

In accordance with one embodiment of the present invention, a multiple switch assembly is provided that includes a lever pivotable about horizontal axes and having arms extending in different horizontal directions. Each arm has a far end lying adjacent to a switch to activate (close or open) the switch when the lever is pivoted. A housing that surrounds most of the lever, includes a cam surface, while a cam follower mounted on the arm far end is spring biased against the cam surface. The cam surface includes a convex surface portion that provides increased resistance to downward movement of an arm, until the tip of the convex surface is reached, after which there is a sudden decrease in resistance to create a "snap" effect.

The switch includes a piece of sheet metal with a ring-like part, and a tongue that extends into the middle of the ring-like part and that is bent at an upward incline. An upside-down cup-shaped elastomeric force transfer element lies between the arm and the tongue.

The lever has a handle that projects through a funnel-shaped hole in the housing and above the housing. The lever includes a convex spherical bearing centered on a vertical axis. The housing has upper and lower concave spherical bearing surfaces respectively on a cover and on a base of the housing. The lever arms extend horizontally through gaps in the bearing surfaces toward corners of a square housing cavity.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
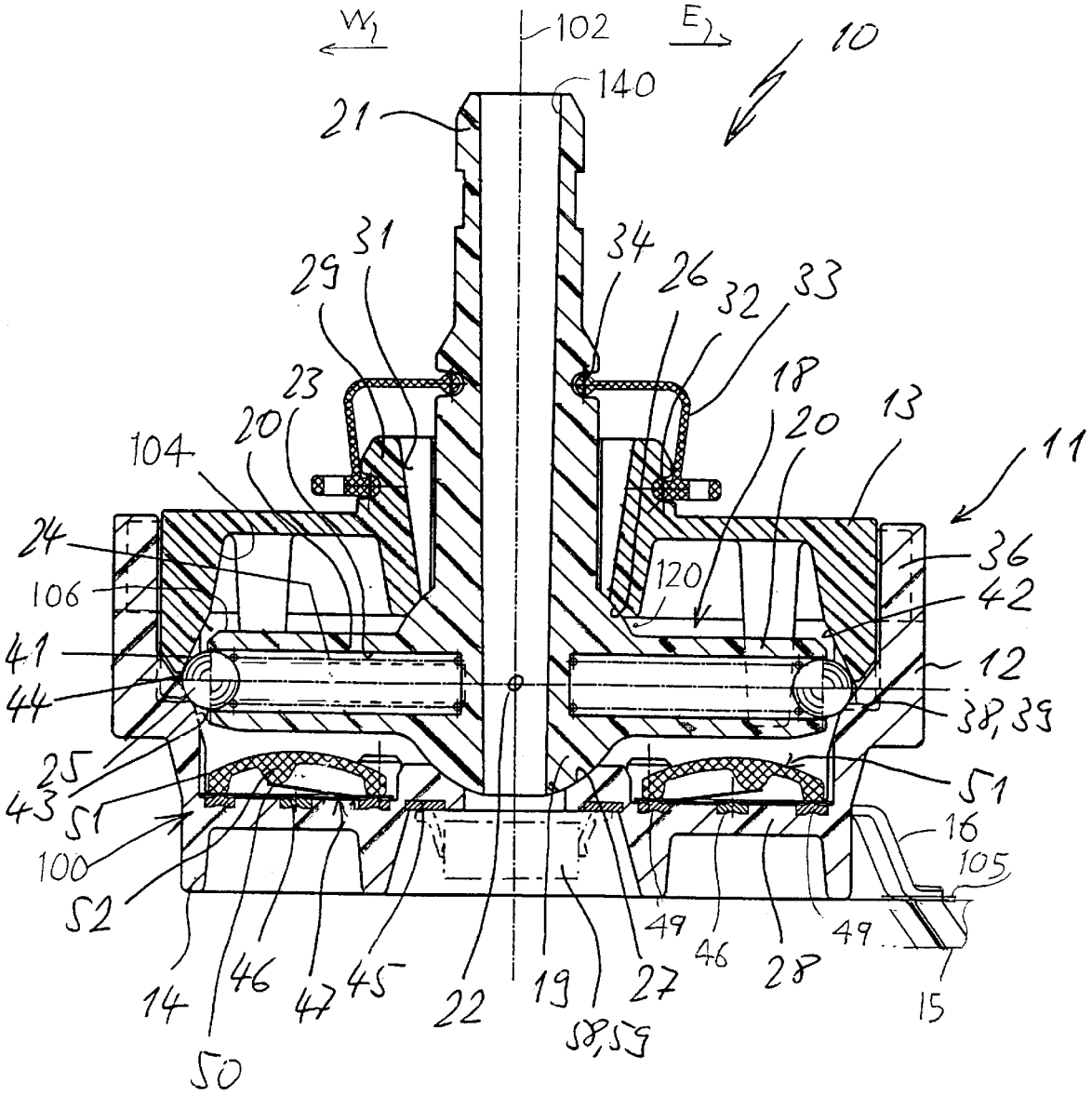
FIG. 1 is a sectional view of a multiple switch assembly of the present invention, with the lever in its neutral position.

FIG. 1 illustrates a multiple switch assembly 10 which includes an actuating member or lever 18, with most of the lever lying within an insulative housing 11. The lever includes a spherical pivot bearing 19 that allows the lever to pivot about horizontal axes. Each lever is horizontally elongated, with its horizontal length greater than its average vertical thickness, especially at the lever far end. The lever includes four similar actuator arms 20 that are each associated with one of four similar switch devices 100. Each switch device, or switch is activated, or closed, when a corresponding arm far end 106 is depressed. Such depression of an arm is accomplished by moving an actuator handle 21 of the lever to tilt the lever about a corresponding horizontal axis. It is noted that the lever is pivotable about two horizontal axes that each pass through a centerpoint 22, and that the handle 21 extends largely vertically along a largely vertical axis 102 that passes through the centerpoint 22 of the two horizontal axes.

The housing 11 includes a main part or base 12 forming a recess with side walls 36, that is open in an upward direction, and a cover 13 that covers the recess to form a largely closed cavity 104. The housing cavity 104 is of largely square shape as seen from above. The base 12 of the housing has feet 14 that may rest on a circuit board. Electrically conductive tails or legs 16 have portions lying outside the housing that extend down to the level of the feet 14 for soldering to traces on the circuit board. The legs also have portions molded into the body, with one leg forming an inner contact 46 and another leg forming an outer contact 49. A sheet metal contact element 47 has a tongue 50 that can be depressed to engage the inner conduct 46. This is accomplished when an actuator arm 20 is depressed, and it depresses a middle part 52 of a force transfer element 51 to depress the tongue 50 against the inner contact 46.

The pivot bearing 19, which has a convex spherical outer surface, and which supports the lever 18 in pivoting about two horizontal axes, is supported by spherical concave bearing surfaces. These include a largely upwardly-facing concave spherical bearing surface 27 on the base 12 of the housing, and a largely downwardly-facing concave bearing surface 26 on the cover. The four actuator arms 20 project primarily horizontally through gap areas 120 between the lower and upper concave spherical bearing surfaces.

The cover 13 has funnel walls 29 that form a largely conical funnel 31, with the actuator handle 21 extending upwardly through the funnel and above it. The funnel allows the actuator handle 21 to pivot in East E and West W direction, and also South and North while providing a pivot limit or stop for the actuator during pivoting in each of these directions. The height of the funnel walls is at least equal to the radius of the bottom of the funnel. A sealing diaphragm 33 is largely ring-shaped with an inner part sealed in a groove 34 to the handle, and with an outer part sealed at a grove 32 to the cover.

Figure 2:
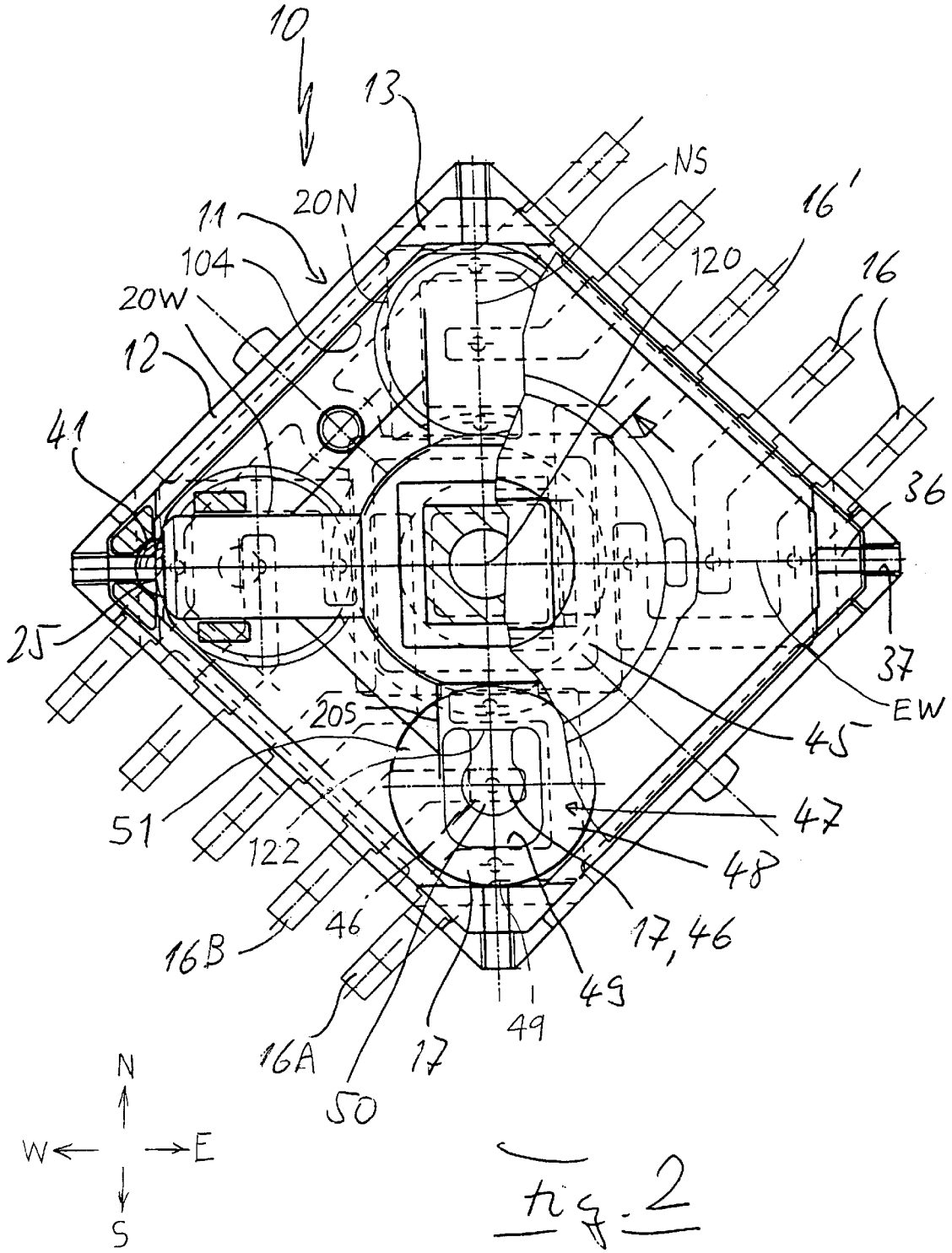
FIG. 2 is a plan view of the switch assembly of FIG. 1, with part of the cover removed.

FIG. 2 shows that the housing cavity 104 is of largely square shape, with the four actuating arms including arms 20W, 20N and 20S, extending in the four directions E, W, N, S from the largely vertical axis 102. The arms extend toward the corners of the square cavity, which minimizes the area occupied by the housing. It can be seen in FIG. 2 that the contact element 47 is a piece of sheet metal with a ring-like part 48 and with a tongue 50 that extends into the empty middle of the ring-shaped part. The tongue has a bend at 122 to extend at an upward incline towards the middle of the empty space of the ring-like portion. One contact leg 16A forms the contact 49 that lies under the ring-like part 48 to engage it, while another contact tail 16B forms the contact 46 that lies under the tongue 50 to be engaged by the tongue when the tongue is depressed. It is noted that a portion of the contact tail 16B lies embedded below the surface that supports the contact element 47.

FIG. 1 shows that the force transfer element 51 is in a shape of an upside-down cup with a bump 52 projecting down to engage the tongue 50. The element is made of an elastomeric material such as silicone and distributes the force of the arm 20 on the tongue. An elastomeric material has a Young's Modulus of Elasticity of not more than about $50\times10^3$ psi.

Each actuating arm 20 has a largely horizontally-extending passage 23. A compression spring such as a helical compression spring 24 lies in the passage. A ball 25 lies at the open far end of the passage furthest from the vertical axis 102, with a portion of the ball projecting out of the passage. The ball, which serves as a cam follower, presses against a cam surface 44 formed by the housing. The cam surface includes upper and lower cam surface portions 41, 43 formed respectively on the cover and the base, and forming a concave surface portion near where they meet. When the handle 21 is moved in the West W direction to lower the West arm and move the ball down along the lower surface portion 43, the ball 25 is pressed further into the passage to further compress the spring. As a result, the handle 21 and lever 18 tend to remain in the initial position wherein the ball lies in the center of the concave cam surface portion.

Figure 3:
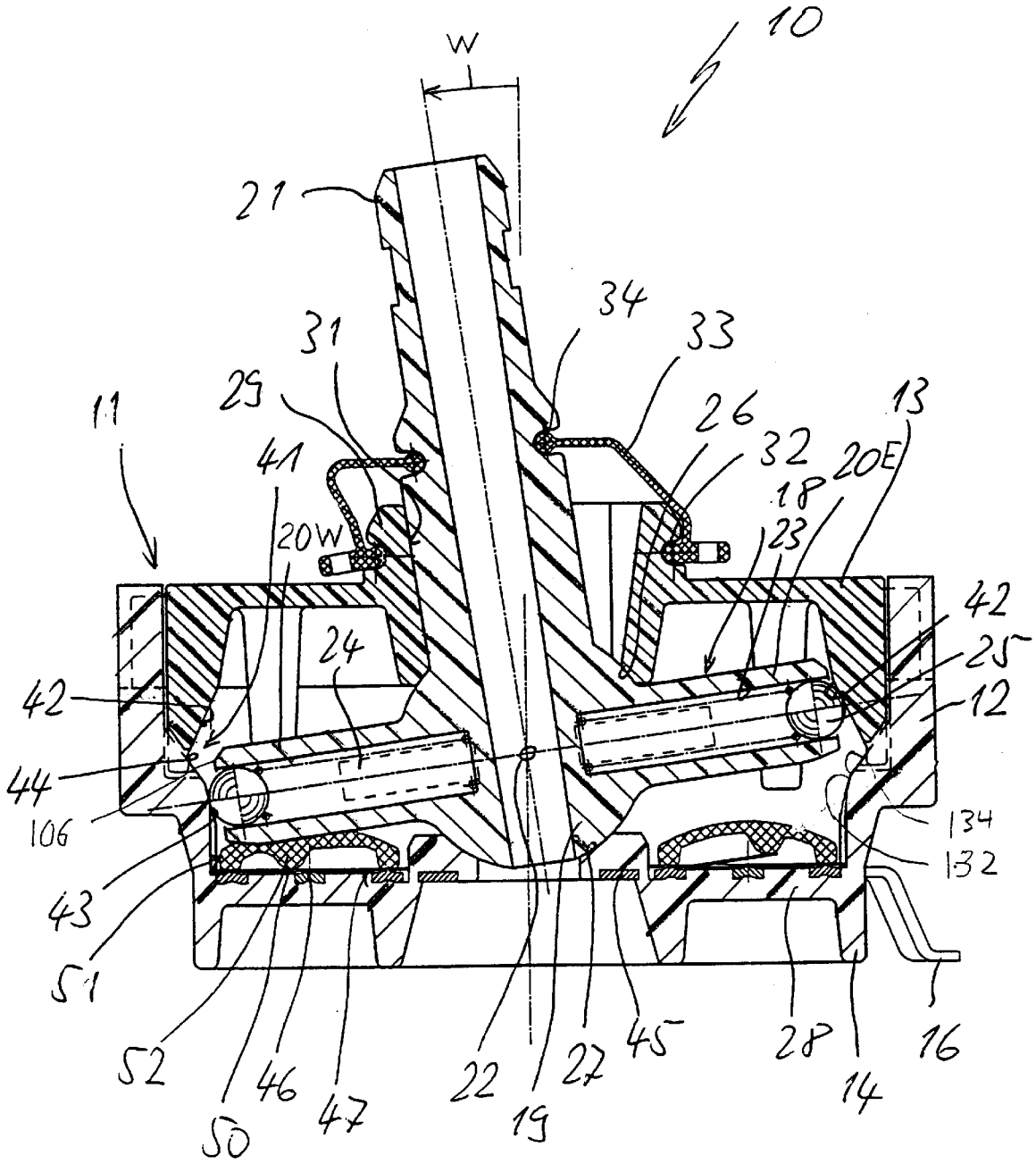
FIG. 3 is a sectional view similar to that of FIG. 1, but with the lever shown fully pivoted in one direction.

FIG. 3 shows the lever handle 21 pivoted in the West direction W from its initial position. The ball moves downward along the cam surface and over a zenith or tip 132 of a convex cam surface region 134. The tip is the point that compresses the spring the most. As the ball moves down towards the tip 132, a progressively increasing force is require to pivot the lever. However, when the ball passes below the tip 132, the force required to move the lever suddenly decreases. At this time, the bump 52 of a mat has substantially fully depressed the tongue into engagement with the center conductor 110 to close the switch. The sudden decrease in resistance to pivoting of the handle 21, provides a tactile feedback to the person, indicating that the switch had been closed. This feedback is similar to that of a snap dome type of actuator wherein the snap dome suddenly snaps down when it is progressively pushed down. It is noted that FIGS. 1 and 3 are sectional views of the cam surfaces, as seen in a horizontal section view.

It is noted that as a far end 106 of arm 20 W moves down, the opposite arm 20E rises and its ball 25 moves upward along the largely vertically-extending cam surface portion 42.

In some cases, the ball 25 rolls vertically along the cam surface as the arm 24W is depressed, thereby reducing the friction. Whether sliding or rolling, the ball can be said to substantially slide vertically along the cam surface.

Figure 4B:
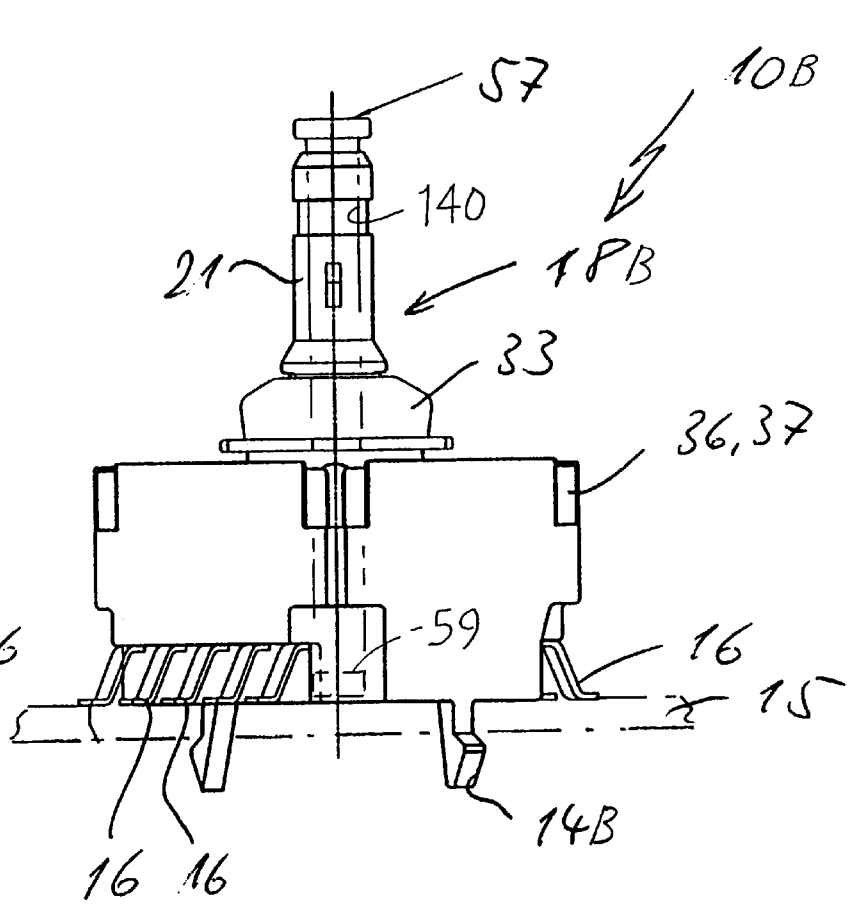
FIGS. 4A and 4B are side elevation views of a multiple switch assembly of another embodiment of the invention.
Figure 4A:
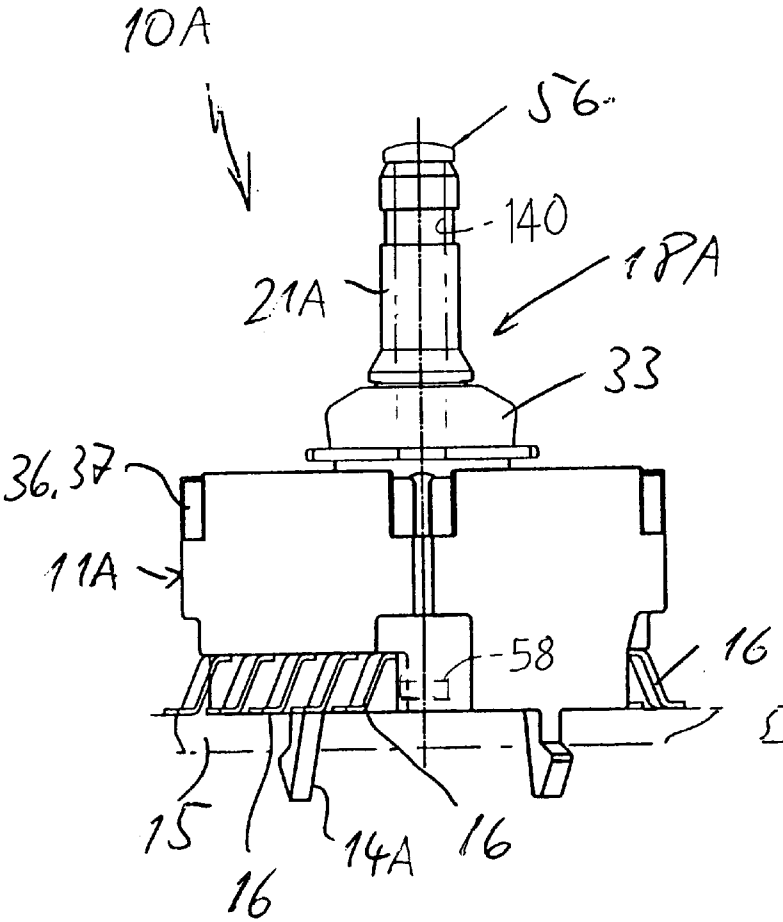

FIGS. 4A and 4B show variations 10A, 10B of the switch assembly, wherein the housing 11A is held to a circuit board 15 by hook-shaped feet 14A, 14B. Contact tails 16 bear against conductor traces on the upper face of the circuit board.

FIG. 4A shows a light guide 56 with an upper end at the top of a handle 21A. The light guide includes a portion that extends down through a hollow center 140 of the actuator handle 18A to an LED 58 that emits light and that is connected to a pair of tails that are soldered to traces 105 on a circuit board. The LED is fixed with respect to the housing 11A. The LED 58 is also shown in FIG. 1.

FIG. 4B shows an actuating rod 57 that extends down through a hollow center 140 of the actuator handle point 18B. When the rod is depressed by a person's thumb, the rod operates a separate switch 59, also shown in FIG. 1, that is fixed with respect to the housing.

While terms such as "horizontal", "West", etc. have been used to help describe the invention as it is illustrated, it should be understood that the switch assembly can be used in any orientation with respect to Earth. Also, a lever that can pivot by its handle moving in West and North directions is the equivalent of a lever that can pivot by moving in East and South directions.

Thus, the invention provides a multiple switch assembly with at least two switches that are operated by pivoting of a lever about at least one horizontal axis. A plurality of arms project primarily horizontally away from a vertical axis of the lever, with each arm operating a switch when the lever is pivoted to move an arm far end vertically. The variation in force required to pivot the lever is controlled by a cam on an arm that presses against a cam surface on the housing or vice-versa. The cam surface preferably has a convex portion that produces a tactile feedback similar to that of a snap dome as the arm approaches its final position. A contact element of each switch can included a piece of sheet metal with a ring-like part and with a tongue that extends into the hollow center of the ring-like part and that is depressed by the arm. An elastomeric force transmitting element preferably lies between the arm and tongue. The handle projects up through a funnel-shaped opening in the housing and above the housing, with the funnel limiting pivoting of the arm in any direction. The housing cavity is square and the arms extend toward the corners.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A multiple switch assembly which includes a housing, a plurality of switch devices that each includes a first contact and a second contact that can be moved against the first contact, and an activating lever with a lower portion lying in said housing, said lever having a handle lying along a primarily vertical axis and having a handle top, wherein:

said lever has a plurality of horizontally extending arm portions with far ends furthest from said vertical axis;

said housing and lever forming a bearing assembly that allows said lever to pivot about each of two perpendicular horizontal axes;

said switch devices each lies adjacent to a corresponding one of said arm portion far ends to be closed when said lever is pivoted to vertically move an adjacent arm portion far end;

said arm portions are horizontally elongated and extend and extend in different primarily horizontal directions away from said vertical axis;

said housing has a plurality of cam surfaces, each lying adjacent to the far end of one of said arm portions;

each of a plurality of said arm portions has a cam follower biased into engagement with one of said cam surfaces;

the second contact of each switch assembly lies above the first contact, so the second contact is depressed when a corresponding arm portion far end is depressed;

each of said cam surfaces has a shape, as seen in a horizontal sectional view taken through the cam surface, with a concave first portion and a convex second portion lying below the concave first portion, said convex second portion having a zenith;

said lever has a handle that extends vertically in an initial position, and that can be titled to lower a corresponding one of said arm portion far ends;

each of said cam followers is positioned to engage a corresponding one of said concave surfaces when the lever is not tilted, and to ride down along the corresponding one of said convex surface and below the zenith to activate a corresponding one of said switches when the lever is tilted to lower the corresponding one of said arm portions.

2. A multiple switch assembly which includes a housing, a plurality of switch devices that each includes a first contact and a second contact that can be moved against the first contact, and an activating lever with a lower portion lying in said housing, said lever having a handle lying along a primarily vertical axis and having a handle top, wherein:

said lever has four horizontally extending arm portions with far ends furthest from said vertical axis;

said housing and lever forming a bearing assembly that allows said lever to pivot about each of two perpendicular horizontal axes;

said switch devices each lies adjacent to a corresponding one of said arm portion far ends to be closed when said lever is pivoted to vertically move an adjacent arm portion far end;

said arm portions are horizontally elongated and extend in different primarily horizontal directions away from said vertical axis;

each of said switches includes one of said first and of said second contacts, said second contact including a piece of sheet metal with a ring-like part, and a tongue which extends into a middle of the ring-like part and which is integral with the ring-like part;

said first contact lying under and spaced from said tongue and said tongue lying under a corresponding one of said arm portion far ends to be depressed when said corresponding one of said arm portions moves down.

3. The switch assembly described in claim 2 including:

a circuit board which has conductive traces;

first and second legs each associated with the first and second contacts of one of said switches, said legs each extending down to said circuit board and soldered to one of said conductive traces;

said legs have upper ends, with said first leg upper end forming said first contact and said second leg having a conductive portion engaged with said ring-like part.

4. The switch assembly described in claim 3 wherein:

said ring-like part lies in a horizontal plane and said tongue is bent to extend at an upward incline from said ring-like part; and including an elastomeric force transmit element lying between each of said arm portion far ends and a corresponding one of said tongues;

said element having an upside-down cup shape with a bottom forming a rim lying on said ring-like part and with a top wall having a downward extending bump lying on said tongue.

5. A multiple switch assembly which includes a housing, a plurality of switch devices, and an activating lever with a lower portion lying in said housing on a primarily vertical axis, wherein:

said housing includes a base and a cover that covers most of said base and that leaves a cavity between them;

said base had a largely upwardly-facing concave spherical bearing surface;

said cover has a largely downwardly-facing concave bearing surface;

said lever has convex spherical lower and upper bearing portions lying respectively against said upwardly-facing and downwardly facing spherical bearing surfaces, and said lever has a plurality of arm portions projecting in different primarily horizontal directions away from said vertical axis and having arm portion far ends lying adjacent to different ones of said switch devices.

a plurality of gap areas lying between said upwardly and downwardly facing bearing surfaces, said arm portions extending largely horizontally through said gap areas;

said housing has a plurality of largely vertically-extending cam surfaces each lying adjacent to one of said arm portion far ends;

each of a plurality of said arm portions has a cam follower biased into engagement with a corresponding one of said cam surfaces;

each of said switch devices lies below a corresponding one of said arm portions to be operated by downward movement of the corresponding arm portion;

each of said cam surfaces had a concave upper portion, and has a convex lower portion with a zenith to provide tactile feedbacks as the arm portion pivots down below the zenith to operate a switch.

6. A multiple switch assembly which includes a housing, a plurality of switch devices, and an activating lever with a lower portion lying in said housing on a primarily vertical axis, wherein:

said housing includes a base and a cover that covers most of said base and the leaves a cavity between them;

said base has a largely upwardly-facing concave spherical bearing surface;

said cover has a largely downwardly-facing concave bearing surface;

said lever has convex spherical lower and upper bearing portion lying respectively against said upwardly-facing and downwardly facing spherical bearing surfaces, and said lever has a plurality of arm portions projecting in different primarily horizontal directions away from said vertical axis and having arm portion far ends lying adjacent to different ones of said switch devices.

a plurality of gap areas lying between said upwardly and downwardly facing bearing surfaces, said arm portions extending largely horizontally through said gap areas;

each of said switch devices includes a piece of sheet metal with a largely ring-shaped planar portion having an empty center, and with a tongue that extends radially inwardly from said ring-shaped portion into said center, the tongue of each of said switch devices being bent to extend out of a plane of the corresponding one of said ring-shaped planar portions.

* * * * *